US008941462B2

(12) United States Patent
Lee et al.

(10) Patent No.: US 8,941,462 B2
(45) Date of Patent: Jan. 27, 2015

(54) OVER-CURRENT PROTECTION DEVICE AND METHOD OF MAKING THE SAME

(71) Applicants: Wen Feng Lee, Taoyuan (TW); Kuo Hsun Chen, Toufen Town (TW); Chun Teng Tseng, Sanwan Township, Miaoli County (TW); Yi An Sha, Xindian (TW); Ming Hsun Lu, Taoyuan (TW)

(72) Inventors: Wen Feng Lee, Taoyuan (TW); Kuo Hsun Chen, Toufen Town (TW); Chun Teng Tseng, Sanwan Township, Miaoli County (TW); Yi An Sha, Xindian (TW); Ming Hsun Lu, Taoyuan (TW)

(73) Assignee: Polytronics Technology Corp., Hsinchu (TW)

( * ) Notice: Subject to any disclaimer, the term of this patent is extended or adjusted under 35 U.S.C. 154(b) by 110 days.

(21) Appl. No.: 13/866,611

(22) Filed: Apr. 19, 2013

(65) Prior Publication Data

US 2014/0035719 A1 Feb. 6, 2014

(30) Foreign Application Priority Data

Jul. 31, 2012 (TW) ..... 101127714 A

(51) Int. Cl.

| | |
|---|---|
| ***H01C 7/10*** | (2006.01) |
| ***H01C 7/00*** | (2006.01) |
| ***H01C 17/00*** | (2006.01) |
| ***H01C 1/028*** | (2006.01) |
| ***H01C 1/14*** | (2006.01) |
| ***H01C 7/02*** | (2006.01) |
| ***H01C 17/02*** | (2006.01) |

(52) U.S. Cl.

CPC ..... *H01C 7/008* (2013.01); *H01C 17/00* (2013.01); *H01C 1/028* (2013.01); *H01C 1/1406* (2013.01); *H01C 7/02* (2013.01); *H01C 17/02* (2013.01)

USPC ..... 338/22 R; 338/13

(58) Field of Classification Search

CPC ..... H01C 7/008; H01C 17/00; H01C 1/028; H01C 7/02

USPC ..... 338/22 R, 13; 29/619

See application file for complete search history.

(56) References Cited

U.S. PATENT DOCUMENTS

| | | | | |
|---|---|---|---|---|
| 6,297,722 | B1 * | 10/2001 | Yeh | 338/22 R |
| 7,173,511 | B2 * | 2/2007 | Han et al. | 338/22 R |
| 7,701,322 | B2 * | 4/2010 | Wang et al. | 338/22 R |
| 2002/0050914 | A1 * | 5/2002 | Chiang et al. | 338/22 R |
| 2003/0030994 | A1 * | 2/2003 | Takaya et al. | 361/728 |
| 2004/0069645 | A1 * | 4/2004 | Chen et al. | 205/80 |
| 2006/0132277 | A1 * | 6/2006 | Hetherton et al. | 336/232 |
| 2006/0202791 | A1 * | 9/2006 | Ho et al. | 338/22 R |
| 2007/0103269 | A1 * | 5/2007 | Han et al. | 338/22 R |

* cited by examiner

*Primary Examiner* — Kyung Lee
(74) *Attorney, Agent, or Firm* — Egbert Law Offices, PLLC

(57) ABSTRACT

An over-current protection device has a PTC device, first and second electrodes and an insulation layer. The PTC device comprises first and second electrically conductive members and a PTC layer laminated between the first and second electrically conductive members. The first and second electrodes are electrically connected to the first and second electrically conductive members, respectively. The insulation layer is disposed on a surface of the first electrically conductive member. The device is a stack structure extending along a first direction, and comprises at least one hole extending along a second direction substantially perpendicular to the first direction. The value of the covered area of the hole divided by the area of the form factor of the over-current protection device is not less than 2%, and the value of the thickness of the device divided by the number of the PTC devices is less than 0.7 mm.

26 Claims, 5 Drawing Sheets

OVER-CURRENT PROTECTION DEVICE AND METHOD OF MAKING THE SAME

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO JOINT RESEARCH AGREEMENT

Not applicable.

INCORPORATION-BY-REFERENCE OF MATERIALS SUBMITTED ON A COMPACT DISC.

Not applicable.

BACKGROUND OF THE INVENTION

1. Field of the invention

The present application relates to an over-current protection device, and more particularly to a surface-mountable over-current protection device and the method of making the same.

2. Description of Related Art Including Information Disclosed Under 37 CFR 1.97 and 37 CFR 1.98.

Over-current protection devices are used for protecting circuitries from damage resulted from over-heat or over-current. An over-current protection device usually contains two electrodes and a resistive material disposed therebetween. The resistive material has positive temperature coefficient (PTC) characteristic that the resistance thereof remains extremely low at room temperature and instantaneously increases to thousand times when the temperature reaches a critical temperature or the circuit has over-current, so as to suppress over-current and protect the cell OF the circuit device. When the resistive material gets back to the room temperature or over-current no longer exists, the over-current protection device returns to be of low resistance and as a consequence the circuitry again operate normally. In view of the reusable property, the PTC over-current protection devices can replace traditional fuses, and have been widely applied to high density circuits.

Electronic apparatuses are being made smaller as time goes on. Therefore, it has to extremely restrict the sizes or thicknesses of active and passive devices. Surface mountable over-current protection devices usually use an insulating adhesive material layer, such as FR-4 or the like used in print circuit board (PCB) manufacturing., to support device rigidity. To acquire good adhesive strength between the PTC material layer and the insulating adhesive material layer, the resin content of the insulating adhesive material layer has to be taken into account. For large resin content, the insulating adhesive material layer is usually thicker and the adhesive force for jointing with the PTC material layer increases. However, the entire thickness of the device will increase significantly. For a small resin content, the insulating adhesive material layer is thinner and as a result that the entire thickness of the device can be diminished. However, the adhesive strength between the insulating adhesive material layer and the PTC material layer and the production yield will decrease. For instance, the over-current protection device containing a single PTC device usually has a thickness larger than 0.8 mm, and the over-current protection device containing two PTC devices connected in parallel has a thickness larger than 1.2 mm.

Accordingly, simultaneous achievements of good adhesive strength and thinning the device are unobtainable; therefore current devices cannot meet the demands of portable apparatuses at present

BRIEF SUMMARY OF THE INVENTION

The present application relates to an over-current protection device, and more particularly to a thin-type over-current protection device and its manufacturing method. In the present application, the insulating adhesive material layer with large resin content is tested and used. On the premise of good production yield and adhesive strength, the insulating adhesive material layer can be thinned by 10%, or up to 20%, thereby effectively decreasing the thickness of the over-current protection device.

In accordance with a first aspect of the present application, an over-current protection device comprises at least one PTC device, a first electrode, a second electrode and an insulating layer. The PTC device has a thickness less than around 0.4 mm and comprises a first electrically conductive member, a second electrically conductive member and a PTC material layer laminated between the first electrically conductive member and the second electrically conductive member. The first electrode is electrically connected to the first electrically conductive member, whereas the second electrode is electrically connected to the second electrically conductive member. The insulating layer is disposed on a surface of the first electrically conductive member and has a thickness ranging from 10 μm to 65 μm. The over-current protection device is a stack structure longitudinally extending along a first direction, and comprises at least one hole extending along a second direction perpendicular to the first direction. In an embodiment, the hole contains a space capable of accommodating resin flow from the insulating layer during manufacturing. The value of the covered area of the hole divided by the area of the form factor of the over-current protection device is not less than 2%, and the value of the thickness of the over-current protection device divided by the number of the PTC devices is less than 0.7 mm.

In accordance with a second aspect of the present application, a method of making an over-current protection device is disclosed. First, providing at least one PTC substrate containing an upper electrically conductive member, a lower electrically conductive member and a PTC material layer laminated therebetween. The upper and lower electrically conductive members are patterned and at least one hole is made in the PTC substrate, the hole extending along a direction substantially perpendicular to an extending direction of the PTC substrate. An insulating layer and two electrodes are stacked on at least one surface of the PTC substrate in sequence. The PTC substrate, the insulating layer and the electrodes are pressed through which resin flow generated from the insulating layer goes into the hole. Conductive connecting members are made in the pressed structure to electrically connect the upper electrically conductive member and one of the electrodes, and the lower electrically conductive member and another one of the electrodes. Subsequently, the electrodes are patterned. The stack structure of the PTC substrate, the insulating layer and the electrode is cut into a plurality of the over-current, protection devices.

This novel design can be applied to over-current protection devices of single or multi-layer PTC material layers, thereby effectively thinning the over-current protection devices to meet the rigorous downsizing requirements of electronic apparatuses.

BRIEF DESCRIPTION OF THE SEVERAL VIEWS OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 1:
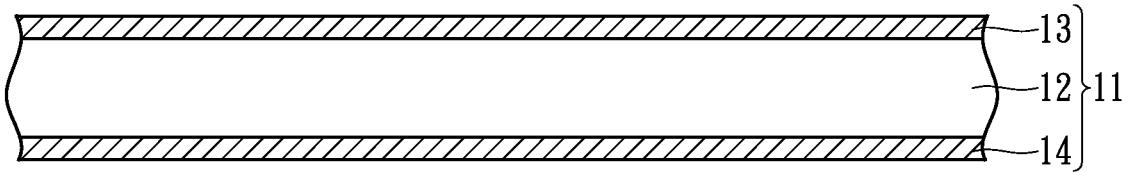
FIGS. 1 to 7 show a process of making an over-current protection device in accordance with an embodiment of the present application.

In FIG. 1, a PTC substrate 11 comprising electrically conductive members 13 and 14 and a PTC material layer 12 is provided. In an embodiment, the PTC material layer 12 contains crystalline polymer and conductive fillers dispersed therein. The crystalline polymer may use crystalline polyolefines (e.g., high-density polyethylene (HDPE), medium-density polyethylene, low-density polyethylene (LDPE), polyvinyl wax, vinyl polymer, polypropylene, polyvinyl chlorine and polyvinyl fluoride), copolymer of olefin monomer and acrylic monomer (e.g. copolymer of ethylene and acrylic acid or copolymer of ethylene and acrylic resin) or copolymer of olefin monomer and vinyl alcohol monomer (e.g., copolymer of ethylene and vinyl alcohol) and may include one or more crystalline polymer materials. Conductive filler may be carbon black, metal powder or conductive ceramic powder. In an embodiment, the conductive members 13 and 14 may be metal foils, alloy foils or the like.

Figure 2:
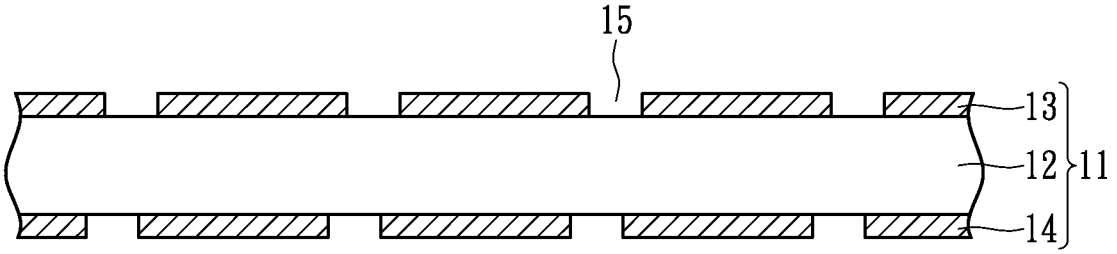

In FIG. 2, the electrically conductive members 13 and 14 are patterned by, for example, etching to form openings 15. In general, each of the openings 15 of the upper conductive member 13 corresponds to an opening 15 of the lower conductive member 14 in vertical; however, they ate misaligned.

Figure 3:
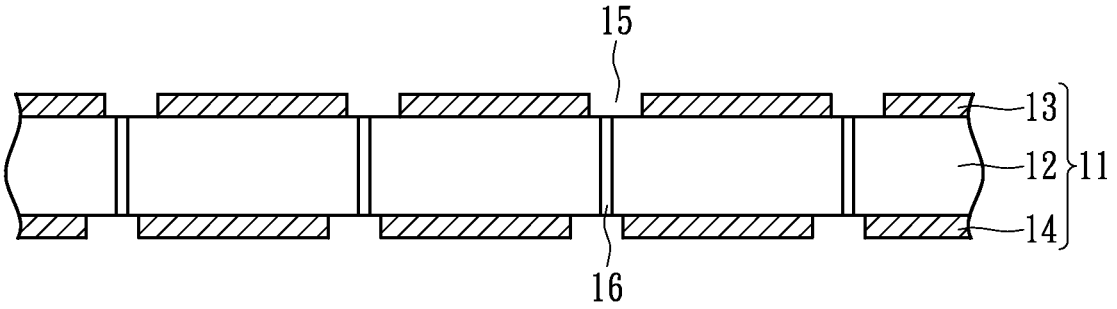

In FIG. 3, in the openings 5, holes 16 through the PTC material layer 12 are formed. The holes 16 extend in a direction perpendicular to the longitudinal extending direction of the PTC substrate 11.

Figure 4:
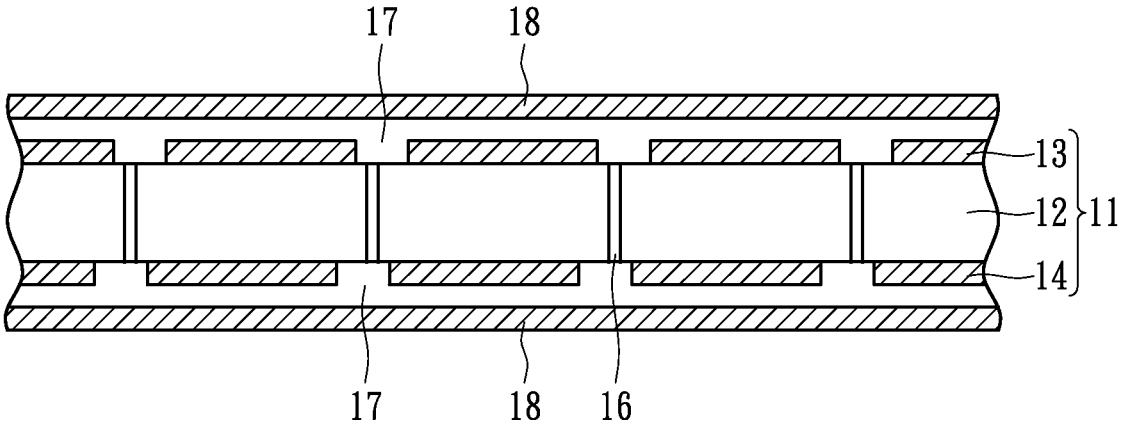

In FIG. 4, in an embodiment, insulating layers 17 and electrode layers 18 are formed on the upper and lower surfaces of the PTC substrate 11 in sequence. It should be noted that only an insulating layer 17 and an electrode layer 18 may be formed on a single surface the PTC substrate 11 if needed. The insulating layer 17 may use prepreg, liquid resin, dry film dielectric layer or adhesive sheet. The liquid resin comprises at least epoxy resin, and may further comprise fillers such as metal oxides, metal hydroxides, metal nitride or the mixture thereof. More specifically, the fillers may comprise aluminum oxide, magnesium oxide, magnesium hydroxide, aluminum hydroxide, aluminum nitride, boron nitride or the mixture thereof. Adhesive sheet comprises epoxy resin and may further comprise flaked reinforced material and/or inorganic fillers. Then, the PTC substrate 11, the insulating layers 17 and the electrode layers 18 are pressed through which resin flow is generated from the insulating layers 17. The holes 16, namely resin flow holes, can accommodate the resin flow. The holes 16 maybe in the shape of circle, ellipse, rectangle, or rectangle with round corners. The hole site or the diameter of the hole 16 is between around 0.3 mm and 3.25 mm, and may be 0.5 mm, 1 mm, 1.5 mm, 2 mm, 2.5 mm or 3 mm. The perimeter of the hole 16 is between 1 mm and 12 mm, and may be 2, 3, 4, 5, 6, 7, 8, 9, 10 or 11 mm.

To acquire good adhesion between the insulating layers 17 and the PTC material layer 11, appropriate resin content of the adhesive material needs to be taken into account. The larger the resin content, the higher the adhesive strength is. However, the larger resin content results in thicker insulating layer 17. The resin flow holes 16 provide space to receive the resin flow generated from the insulating layers 17 during pressing, thereby the insulating layers 17 becomes thinner. For instance, given the insulating layer 17 comprises prepreg and has a thickness of about 65 μm, the insulating layer 17 can be thinned to 60 μm after pressing. If the insulating layer 17 is about 45 μm in thickness, it would become around 40 μm after pressing. For the case using liquid resin or dry film dielectric layer as the material of the insulating layer 17, the thickness can decrease to be less than 40 μm after pressing and curing. For that case using adhesive sheet as the material of the insulating layer 17, the thickness of the insulating layer 17 after pressing and curing can be less than 35 μm, or even 15 μm.

Subsequently, conductive through holes are made in the laminated structure of PTC substrate 11, the insulating layer 17 and the electrode layers 18 to form conductive connecting members 1 9 and 29, as shown in FIG, 5, through which electrically connecting the electrode 18 and the conductive members 13 and 14. In an embodiment, the conductive connecting members 19 and 29 can be made by drilling holes followed by plating conductive films thereon. The electrode layers 18 are patterned to form separated first electrode 21 and second electrode 22. Solder masks 20 can be formed between the first electrode 21 and the second electrode 22. In this embodiment, the formation of the conductive connecting members 19 and 29 is to make holes at the same positions of the holes 16. It is preferred that the size of the holes constituting conductive connecting members 19 and 20 is equal to or greater than that of the resin flow holes 16, so as to remove the resin which may remain in the holes 16. In other words, the holes corresponding to the conductive connecting members 19 and 20 contain spaces taken up by the resin flow holes 16.

Figure 5:
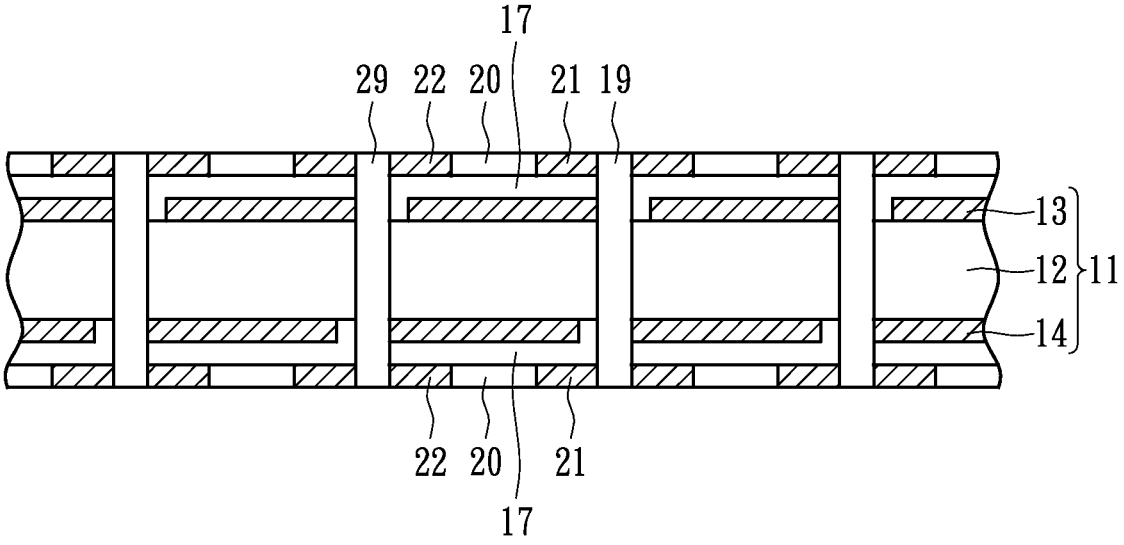
Figure 6:
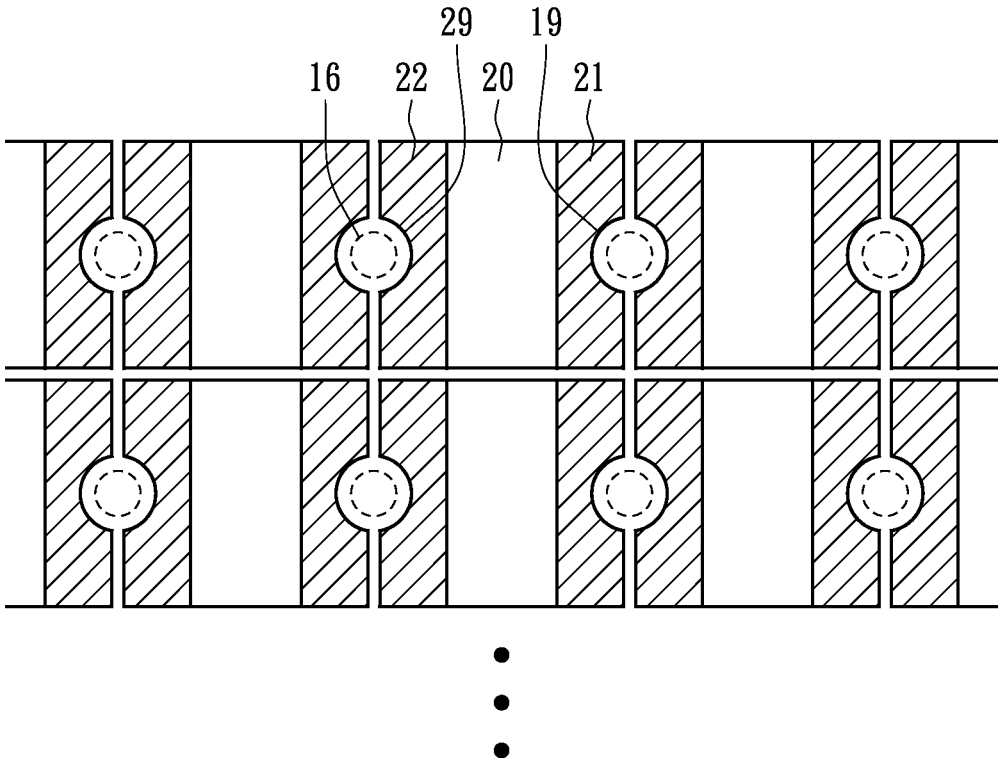

FIG. 6 exemplifies a top view of the substrate in FIG. 5. The conductive connecting members 19 and 29 are placed at the center portions of two ends of each of the over-current protection devices, and overlap the holes 16, which are denoted by dotted-lines, shown in FIG. 3. More specifically, each of the holes 16 is placed between two of adjacent over-current protection devices, and the conductive connecting members 19 and 29 overlap the holes 16 in cross-sectional view. In an embodiment, the size of the holes constituting the conductive connecting members 19 and 29 is equal to or larger than that of the holes 16. Accordingly, when the conductive connecting members 19 and 29 are being made, the residue of resin on the sidewall of the holes 16 can be stripped off to ensure complete removal of residual resin.

Figure 7:
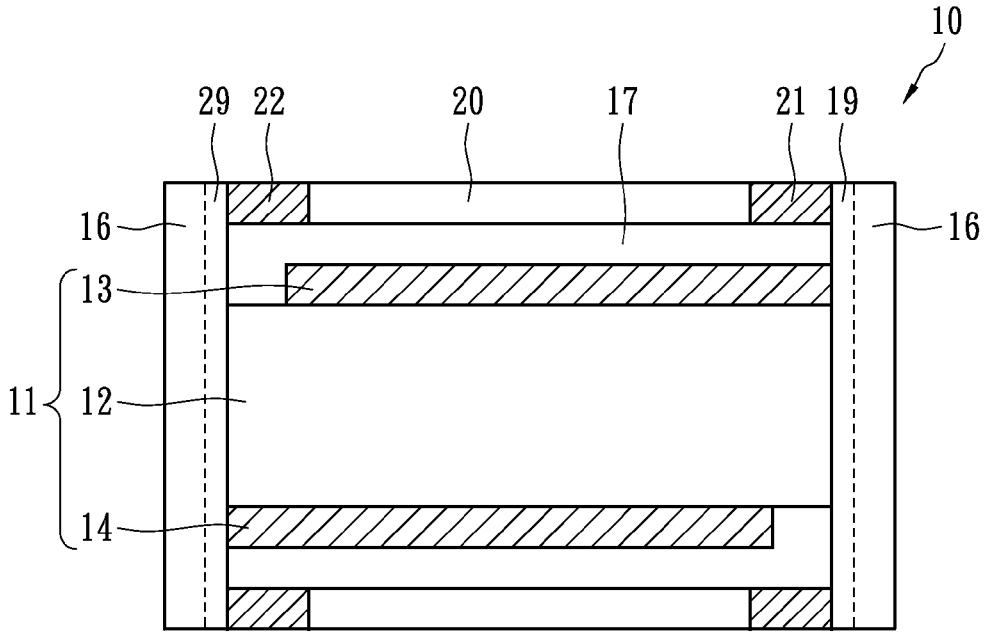
Figure 8:
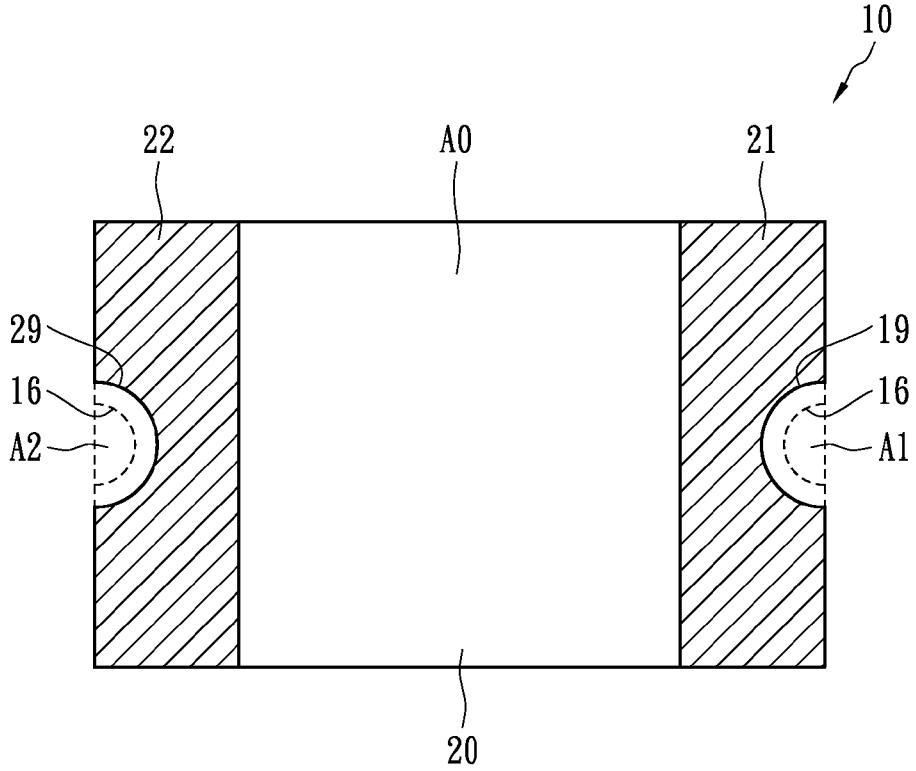
FIG. 8 shows the top view of the over-current, protection device in FIG. 7.

Subsequently, the substrate shown in FIG. 6 is cut into pieces to form a plurality of surface mountable over-current protection devices 10 as shown in FIG. 7 and FIG. 8. FIG. 7 and FIG. 8 show the side view and the top view of the over-current protection device 10, respectively. The over-current protection device 10 is a stack structure of a longitudinal direction extending along a first direction, and comprises a PTC device 11, the insulating layers 17, the first electrode 21, the second electrode 22 and conductive connecting members 19 and 29. The holes corresponding to the conductive connecting members 19 and 29 contain spaces taken up by the holes 16. The first electrode 21 is electrically connected to the conductive member 13 through the conductive connecting member 19, whereas the second electrode 22 is electrically connected to the conductive member 14 through the conductive connecting member 29. The conductive connecting member 19 and 29 may be two semi-circular conductive through boles on two opposite lateral surfaces of the over-current protection device 10, and the semi-circular through hole comprises the bole 16. In an embodiment, the PTC device 11 has a thickness less than 0.4 mm, or less than 0.36 mm or 0.32 mm in particular. The insulating layers 17 are disposed on the conductive members 13 and 14, and the thickness of the insulating layer 17 is between 10 μm and 65 μm, or 15 μm and 45 μm, and may be 20 μm, 30 μm, 40 μm, 50 μm or 60 μm. The hole 16 longitudinally extends along a second direction which is substantially perpendicular to the first direction. The hole 16 can receive the resin flow generated from the insulating layer 17 during manufacturing. In this embodiment, the over-current protection device 10 comprises only one PTC material layer 12, and has a thickness less than around 0.55 mm, or 0.5 mm in particular.

The surface mountable over-current protection device in the market has a specific structure defined by a form factor indicating, the length and width of the device. The length and the width define the covered area of the over-current protection device. For instance, a device of SMD1812 indicates that it has a length of 0.18 inch and a width of 0.12 inch. Therefore, the covered area is equal to 0.18 inch×0.12 inch=4.572 mm×3.048 mm=13.9355 $mm^2$. In this embodiment, the area of the insulating layer 17 is equal to the subtraction of the semi-circular areas of the conductive connecting members 19 and 29 from the covered area. The larger the covered area, the larger the area of the insulating layer 17 is. The total area of the resin flow holes 16 is proportional to the covered area defined by the form factor, so as to effectively accommodate the resin flow generated from the insulating layers 17.

Referring to FIG. 8, in an embodiment. A0 is the covered area, i.e., the rectangular area, defined by the form factor of the device. A1 is the cross-sectional area of semi-circular resin flow hole 16 corresponding to the conductive connecting member 19, whereas A2 is the cross-sectional area of the semi-circular resin flow hole 16 corresponding to the conductive connecting member 29. The ratio of the total area of the resin flow holes 16 to the covered area of the device is equal to (A1+A2)/A0. In practice, the ratio is equal to or greater than 2%, or approximately 2-50% or 4-22%. The ratio may be 8%, 10%, 15%, 20%, 25%, 30%, 35%, 40% or 45%.

Figure 9:
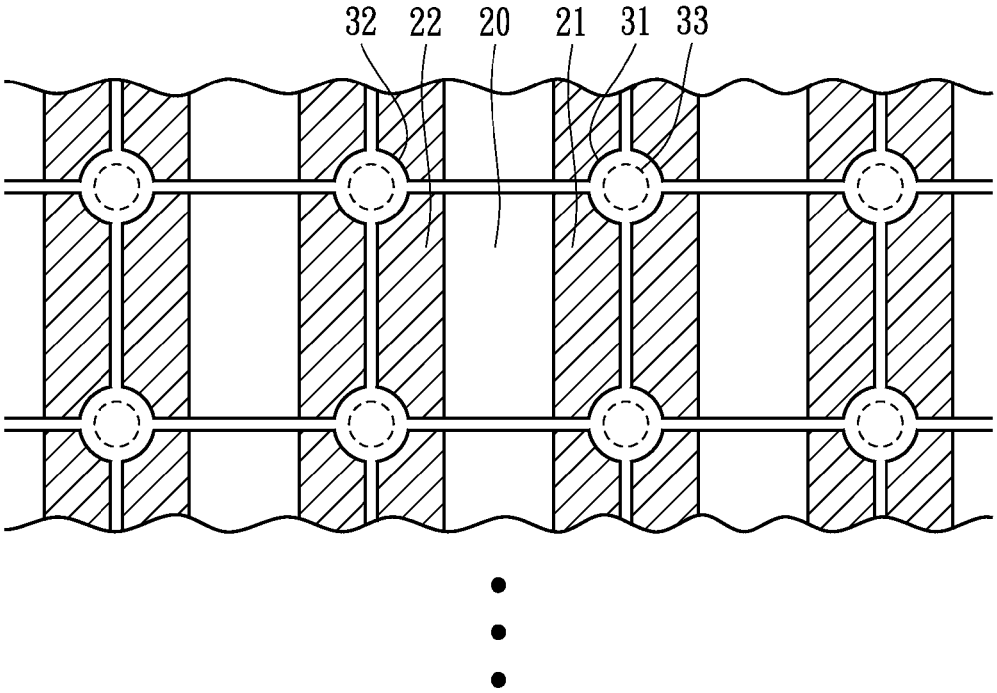
FIG. 9 shows another process of making an over-current protection device in accordance with the present application.

Compared to the device shown in FIG. 6, the conductive connecting members 31 and 32 in FIG. 9 are formed at the corners of the rectangular over-current protection device 10. Likewise, resin flow holes 33 are formed first and then the conductive connecting members 31 and 32 are made at the same positions. The resin flow hole 33 is placed among four adjacent over-current protection devices 10, and the hole corresponding to the conductive connecting members 31 and 32 overlap the hole 33. Preferably, the hole corresponding to conductive connecting members 31 and 32 is equal to or greater than that of the resin flow hole 33 in a cross-sectional view.

Figure 10:
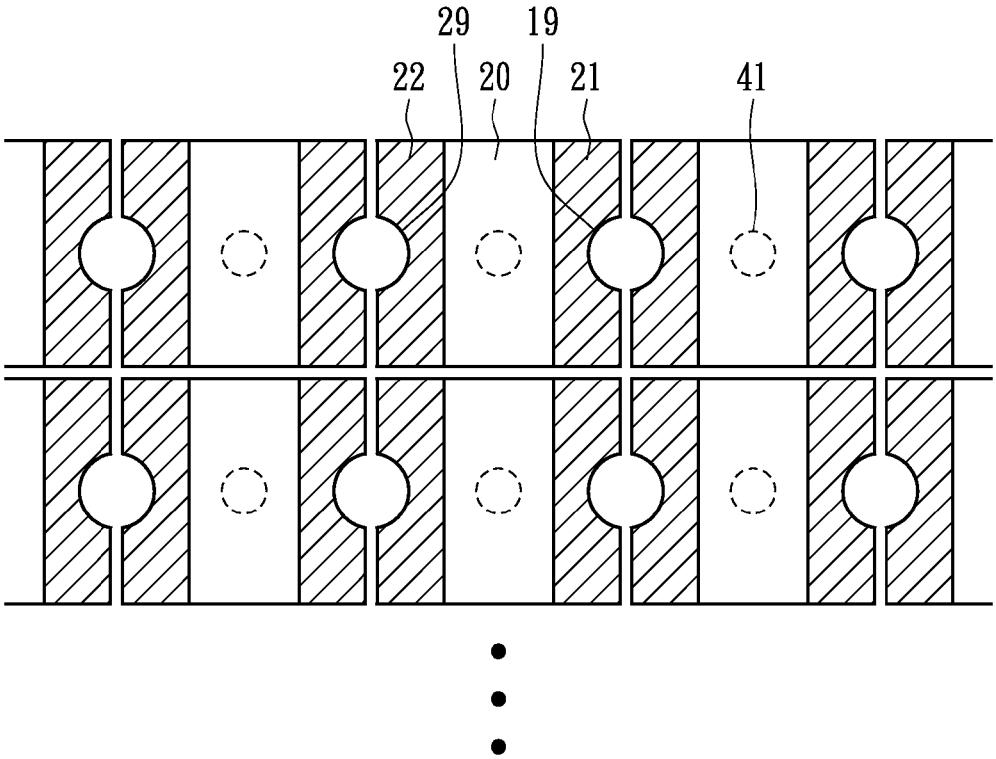
FIG. 10 shows yet another process of making an over-current protection device in accordance with the present application.

Referring to FIG. 10, the resin flow holes 41 can be placed inside or at the center of the over-current protection devices. As a result, the resin flow holes 41 and the conductive connecting members 19 and 29 are not placed at the same positions. It should be noted that each of the over-current protection device is not limited to contain only one resin flow hole 41. The over-current protection device may contain a plurality of resin flow holes 41 if desired.

In accordance with the designs of FIGS. 6, 9 and 10, the resin now holes of the over-current protection device are in the shapes of semicircle, quadrant and circle, respectively, and their radius is between 0.15 mm and 1.63 mm.

Referring to FIG. 7 again, a single PTC material layer 12 is laminated between two insulating layers 17, and the electrodes 21 and 22 are formed on both sides of the device 10. However, the device structure of the present application is not limited to the device 10 in FIG. 7, other structures that contain two or more PTC material layers, a single insulating layer, or two electrodes on a single side are also covered by the scope of the present application. Such structures of surface mountable over-current protection devices are disclosed in U.S. Pat. No. 7,701,322, and are expressly incorporated herein by reference. For example, for an over-current protection device comprising two superimposed PTC devices connected in parallel, the thickness of the over-current protection device can thinned to be equal to or less than 0.8 mm, 0.75 mm, or 0.7 mm by introducing resin flow hole design in the manufacturing process. In an embodiment, the value of the thickness of the over-current protection device divided by the number of the PTC devices is less than 0.7 mm, or less than 0.6 mm or 0.5 mm in particular.

The over-current protection device of the present application relates to a thin-type device. On the premise of good production yield and adhesive strength, the thickness of the insulating layer of high resin content can be decreased by 10% or up to 20% after pressing, so that the entire thickness of the over-current protection device can be diminished effectively.

The above-described embodiments of the present invention are intended to be illustrative only. Numerous alternative embodiments may be devised by persons skilled in the art without departing from the scope of the following claims.

We claim:

1. An over-current protection device; comprising:

at least one PTC device of a thickness less than 0.4 mm, the PTC device comprising a first electrically conductive member, a second electrically conductive member and a PTC material layer laminated between the first and second electrically conductive members;

a first electrode electrically connected to the first electrically conductive member;

a second electrode electrically connected to the second electrically conductive member;

a first insulating layer disposed on the first electrically conductive member and having a thickness between 10 μm and 65 μm; and a second insulating layer disposed on the second electrically conductive member, the second insulating layer having a thickness between 10 μm and 65 μm;

wherein the over-current protection device is a stacked structure in which the first insulating layer is an intermediate layer laminated between the PTC device and the first and second electrodes at a side of the PTC device, and the second insulating layer is another intermediate layer laminated between the PTC device and the first and second electrodes at another side of the PTC device;

wherein the over-current protection device extends along a first direction; and comprises at least one hole extending along a second direction substantially perpendicular to the first direction, the hole is in direct contact with lateral surfaces of the first and second insulating layers such that a space of the hole is capable of accommodating resin flow generated from the first and second insulating layers during manufacturing, a value of a covered area of the hole divided by an area of the form factor of the over-current protection device is equal to or greater than 2%, and a value of the thickness of the over-current protection device divided by the number of the PTC devices is less than 0.7 mm.

2. The over-current protection device of claim 1, wherein the at least one hole electrically connects the first electrode and the first electrically conductive member or the second electrode and the second electrically conductive member.

3. The over-current protection device of claim 1, wherein the first insulating layer has a thickness between 15 μm and 45 μm.

4. The over-current protection device of claim 1, wherein the first insulating layer uses prepreg, liquid resin, dry film dielectric layer, adhesive sheet or the combination thereof.

5. The over-current protection device of claim 1, wherein the over-current protection device comprises two PTC devices, one is superimposed on another, and the over-current protection device has a thickness less than 0.8 mm.

6. The over-current protection device of claim 1, further comprising:

a first conductive connecting member electrically connecting the first electrically conductive member and the first electrode; and a second conductive connecting member electrically connecting the second electrically conductive member and the second electrode.

7. The over-current protection device of claim 6, wherein the first conductive connecting member and the second conductive connecting member are two semi-circular conductive through holes on two opposite lateral surfaces of the over-current protection device, and the semi-circular through hole comprises the hole.

8. The over-current protection device of claim 6, wherein the first conductive connecting member and the second conductive connecting member are conductive through holes placed at corners of the over-current protection device, and the conductive through holes comprise the hole.

9. The over-current protection device of claim 1, wherein the hole is within the over-current protection device.

10. The over-current protection device of claim 1, wherein the value of the covered area of the hole divided by the area of the form factor of the over-current protection device is equal to or less than 50%.

11. The over-current protection device of claim 1, wherein the value of the covered area of the hole divided by the area of the form factor of the over-current protection device is between 4% and 22%.

12. The over-current protection device of claim 1, wherein the hole is in the shape of circle, semicircle or quadrant, and has a radius between 0.15 mm and 1.63 mm.

13. The over-current protection device of claim 1, wherein the perimeter of the hole is between 1 mm and 12 mm.

14. The over-current protection device of claim 1, wherein the insulating layer generates resin flow during pressing.

15. The over-current protection device of claim 1, wherein the value of the thickness of the over-current protection device divided by the number of the PTC devices is less than 0.6 mm.

16. A method of making over-current protection devices, the method comprising:

providing at least one PTC substrate having an upper electrically conductive member, a lower electrically conductive member and a PTC material layer laminated therebetween;

patterning the upper and lower electrically conductive members;

forming at least one hole in the PTC substrate, the hole extending along a first direction perpendicular to a second direction along which the PTC substrate extends;

forming first and second insulating layers and two electrodes in sequence on two opposite surfaces of the PTC substrate to form a stacked structure in which the first insulating layer is an intermediate layer laminated between the PTC substrate and one of the two electrodes at a side of the PTC substrate, the second insulating layer is another intermediate layer laminated between the PTC substrate and another one of the two electrodes at another side of the PTC substrate, the first and second insulating layers overlaying and being in direct contact with openings of the at least one hole;

pressing the PTC substrate, the first and second insulating layers and the two electrodes through which resin flow from the first and second insulating layers goes into the hole;

forming conductive connecting members to electrically connect the upper electrically conductive member and one of the electrodes, and the lower electrically conductive member and another one of the electrodes;

patterning the electrodes; and cutting the PTC substrate, the first and second insulating layers and the electrodes to form a plurality of over-current protection devices.

17. The method of claim 16, wherein a value of a covered area of the hole divided by an area of the form factor of the over-current protection device is equal to or greater than 2%.

18. The method of claim 17, wherein the value of the covered area of the hole divided by the area of the form factor of the over-current protection device is equal to or less than 50%.

19. The method of claim 16, wherein each of the first and second insulating layers has a thickness between 10 μm and 65 μm.

20. The method of claim 16, wherein the hole is placed between adjacent two over-current protection devices, one of the conductive connecting members overlaps the hole, and the conductive connecting member is larger than the hole in cross-section.

21. The method of claim 16, wherein the hole is placed among four adjacent over-current protection devices, one of the conductive connecting member overlaps the hole, and the conductive connecting member is larger than the hole in cross-section.

22. The method of claim 16, wherein the hole is within one of the over-current protection devices.

23. The method of claim 16, wherein the hole is in the shape of circle, ellipse, rectangle or rectangle with round corners.

24. The method of claim 16, wherein one of the over-current protection devices comprises a single PTC material layer and has a thickness less than 0.55 mm.

25. The method of claim 16, wherein one of the overcurrent protection devices comprises two PTC material layers and has a thickness less than 0.8 mm.

26. The method of claim 16, wherein the insulating layer is thinned by 10% after pressing.

* * * * *